US010188167B2

(12) United States Patent
Kass et al.

(10) Patent No.: US 10,188,167 B2
(45) Date of Patent: Jan. 29, 2019

(54) TIME TRIAL BICYCLE HELMET WITH EAR SHIELD

(71) Applicant: Bell Sports, Inc., Scotts Valley, CA (US)

(72) Inventors: Samuel Kass, Santa Cruz, CA (US); Robert Wesson, Santa Cruz, CA (US)

(73) Assignee: Bell Sports, Inc., Scotts Valley, CA (US)

( * ) Notice: Subject to any disclaimer, the term of this patent is extended or adjusted under 35 U.S.C. 154(b) by 91 days.

(21) Appl. No.: 15/187,500

(22) Filed: Jun. 20, 2016

(65) Prior Publication Data

US 2016/0366968 A1 Dec. 22, 2016

Related U.S. Application Data

(60) Provisional application No. 62/181,377, filed on Jun. 18, 2015.

(51) Int. Cl.

| | |
|---|---|
| ***A42B 1/08*** | (2006.01) |
| ***A42B 3/04*** | (2006.01) |
| ***A42B 3/06*** | (2006.01) |
| ***A42B 3/16*** | (2006.01) |
| ***A42B 3/28*** | (2006.01) |
| ***A42B 3/22*** | (2006.01) |

(52) U.S. Cl.

CPC ..... *A42B 3/0493* (2013.01); *A42B 3/066* (2013.01); *A42B 3/163* (2013.01); *A42B 3/221* (2013.01); *A42B 3/283* (2013.01)

(58) Field of Classification Search

CPC ..... A42B 3/0493; A42B 3/163; A42B 3/14; A42B 3/127; A42B 3/221; A42B 3/066; A42B 3/227; A42B 3/18; A42B 3/283; A42B 3/222; A61F 9/029

USPC ..... 2/423

See application file for complete search history.

(56) References Cited

U.S. PATENT DOCUMENTS

| | | | | |
|---|---|---|---|---|
| 3,259,908 | A * | 7/1966 | Simpson | A61F 9/025 2/9 |
| 3,551,910 | A * | 1/1971 | Raschke | A42B 3/32 2/415 |
| 5,929,963 | A * | 7/1999 | McNeal | A61F 9/025 351/47 |
| 5,991,930 | A * | 11/1999 | Sorrentino | A42B 3/22 2/424 |
| 6,804,829 | B2 * | 10/2004 | Crye | A42B 3/08 2/10 |
| 8,555,424 | B2 * | 10/2013 | Higgins | A42B 3/223 2/15 |

(Continued)

FOREIGN PATENT DOCUMENTS

| | | |
|---|---|---|
| CN | 204335934 U | 5/2015 |

*Primary Examiner* — Timothy K Trieu
(74) *Attorney, Agent, or Firm* — Booth Udall Fuller, PLC

(57) ABSTRACT

A helmet can include a helmet body and a shield. The helmet body can include a front portion and a tail portion, and the shield can include two ear portions connected by a brow portion. The shield can be releasably coupled to the helmet body. The ears of a helmet user can be exposed with respect to the helmet body and covered with respect to the shield. The brow portion of the shield can extend across the front portion of the helmet. The tail portion of the helmet can be tapered and the front portion of the helmet can have a rounded leading edge, such that the helmet body has a tear drop form factor.

20 Claims, 14 Drawing Sheets

(56) References Cited

U.S. PATENT DOCUMENTS

| | | | | |
|---|---|---|---|---|
| 2013/0191974 | A1 | 8/2013 | Lebel | |
| 2015/0250249 | A1 * | 9/2015 | Jacobsen | A42B 3/12 2/424 |

* cited by examiner

TIME TRIAL BICYCLE HELMET WITH EAR SHIELD

RELATED APPLICATIONS

This application claims the benefit of U.S. provisional patent application 62/181,377, filed Jun. 18, 2015 titled "Time Trial Bicycle Helmet," the entirety of the disclosure of which is hereby incorporated by this reference.

TECHNICAL FIELD

Aspects of this document relate generally to time trial bicycle helmets with removable shields.

BACKGROUND

Protective headgear and helmets have been used in a wide variety of applications and across a number of industries including sports, athletics, construction, mining, military defense, and others, to prevent damage to a user's head and brain. Bicycle time trials are a use scenario where sometimes-conflicting needs are carefully balanced. The goal of a cycling time trial is to traverse a course or track in the fastest time possible. Aerodynamic advantages may improve time trial results. A time trial helmet ideally will provide an aerodynamic advantage without sacrificing the protection afforded the user. At the same time, the helmet needs to be comfortable enough to not interfere with race performance. Thus, ventilation and weight are concerns that need to be balanced against the protection and reduced drag.

Aerodynamic and comfort advantages are to be had by covering the eyes and ears of the rider. Conventional time trial helmets, as known in the art, have included ear covers integrated or formed as part of the helmet body. Conventional helmets have also included removable eye shields that have just covered the eyes of the user.

SUMMARY

A need exists for a time trial bicycle helmet with improved aerodynamics and ventilation. Accordingly, in an aspect, a helmet comprises a helmet body and a shield. The helmet body comprises a front portion and a tail portion. The shield comprises two ear shield portions connected to each other adjacent the front portion of the helmet body by a brow portion. The shield is releasably coupled to the helmet body. The helmet body is configured to avoid covering ears of a wearer of the helmet body to leave a majority of the ear exposed with respect to the helmet body. Finally, the ear shield portions are configured to extend to the helmet body over the ears of the wearer when connected to the helmet body adjacent to the front portion.

An outer surface of the brow portion of the shield may be recessed with respect to an outer surface of the front portion of the helmet body such that at least part of the helmet body overhangs the brow portion of the shield. Outer surfaces of the two ear portions of the shield may be in direct contact with an outer surface of the tail portion of the helmet body. The helmet may further comprise at least one body magnet and/or at least one shield magnet coupled to the shield. The at least one body magnet may be encased within the helmet body. The at least one body magnet and the at least one shield magnet may be aligned with respect to each other when the shield is connected to the helmet body.

The helmet may further comprise a shield vent at a top edge of the brow portion of the shield that may be separated from a corresponding portion of the front portion of the helmet body and may leave an opening between the brow portion of the shield and the front portion of the helmet body when the shield is connected to the helmet body. The helmet body may comprise at least one interior channel that may direct air passing through the at least one brow vent into the helmet.

The front portion of the helmet body may comprise a maximum thickness in a range of 40-50 mm. The tail portion of the helmet body may comprise a maximum thickness greater than the maximum thickness of the front portion. The average thickness of the portion of the helmet body not included in either the front portion or the tail portion may be in a range of 20-26 mm. Each ear portion of the shield may comprise at least one ear vent extending through the ear portion of the shield. Finally, the brow portion of the shield may comprise an eye shield that may extend downward from the brow portion and may be configured to cover at least the eyes of the helmet wearer.

In another aspect, a helmet comprises a helmet body and a shield. The helmet body comprises a front portion and a tail portion. The shield comprises two ear portions connected by a brow portion adjacent the front portion of the helmet body. The shield is magnetically coupled to the helmet body. The helmet body is configured to avoid covering ears of a wearer of the helmet body to leave a majority of the ear exposed with respect to the helmet body, and the two ear portions of the shield are configured to extend to the helmet body over the ears of the wearer when connected to the helmet body adjacent to the front portion. Lastly, the tail portion is tapered and the front portion has a rounded leading edge, such that the helmet body has a tear drop form factor.

An outer surface of the brow portion of the shield may be recessed with respect to an outer surface of the front portion of the helmet body such that at least part of the helmet body may overhang the brow portion of the shield. Both outer surfaces of the two ear portions of the shield may be substantially flush with an outer surface of the tail portion of the helmet body.

Also, the helmet may further comprise at least one indentation set in a lip of the helmet body, at least one body magnet encased within the helmet body near the at least one indentation, and at least one shield magnet coupled to the shield and sized to fit within the at least one indentation. The at least one body magnet and the at least one shield magnet may be aligned with respect to each other when the shield is connected to the helmet body.

In yet another aspect, a helmet comprises a helmet body and a shield. The helmet body comprises a front portion, a tail portion, and a plurality of body magnets. The shield comprises a plurality of shield magnets and two ear portions connected by a brow portion adjacent the front portion. The shield is releasably coupled to the helmet body by magnetic attraction between the plurality of body magnets and the plurality of shield magnets. Furthermore, the helmet body is configured to avoid covering ears of a wearer of the helmet body to leave a majority of the ear exposed with respect to the helmet body, and the two ear portions of the shield are configured to extend to the helmet body over the ears of the wearer when connected to the helmet body adjacent to the front portion. Finally, an outer surface of the shield may be recessed with respect to an outer surface of the front portion of the helmet body. The outer surface of the shield may be substantially flush with an outer surface of the tail portion of the helmet body.

The foregoing and other aspects, features, and advantages will be apparent to those artisans of ordinary skill in the art from the DESCRIPTION and DRAWINGS, and from the CLAIMS.

BRIEF DESCRIPTION OF THE DRAWINGS

The invention will hereinafter be described in conjunction with the appended drawings, where like designations denote like elements, and.

DETAILED DESCRIPTION

Figure 1:
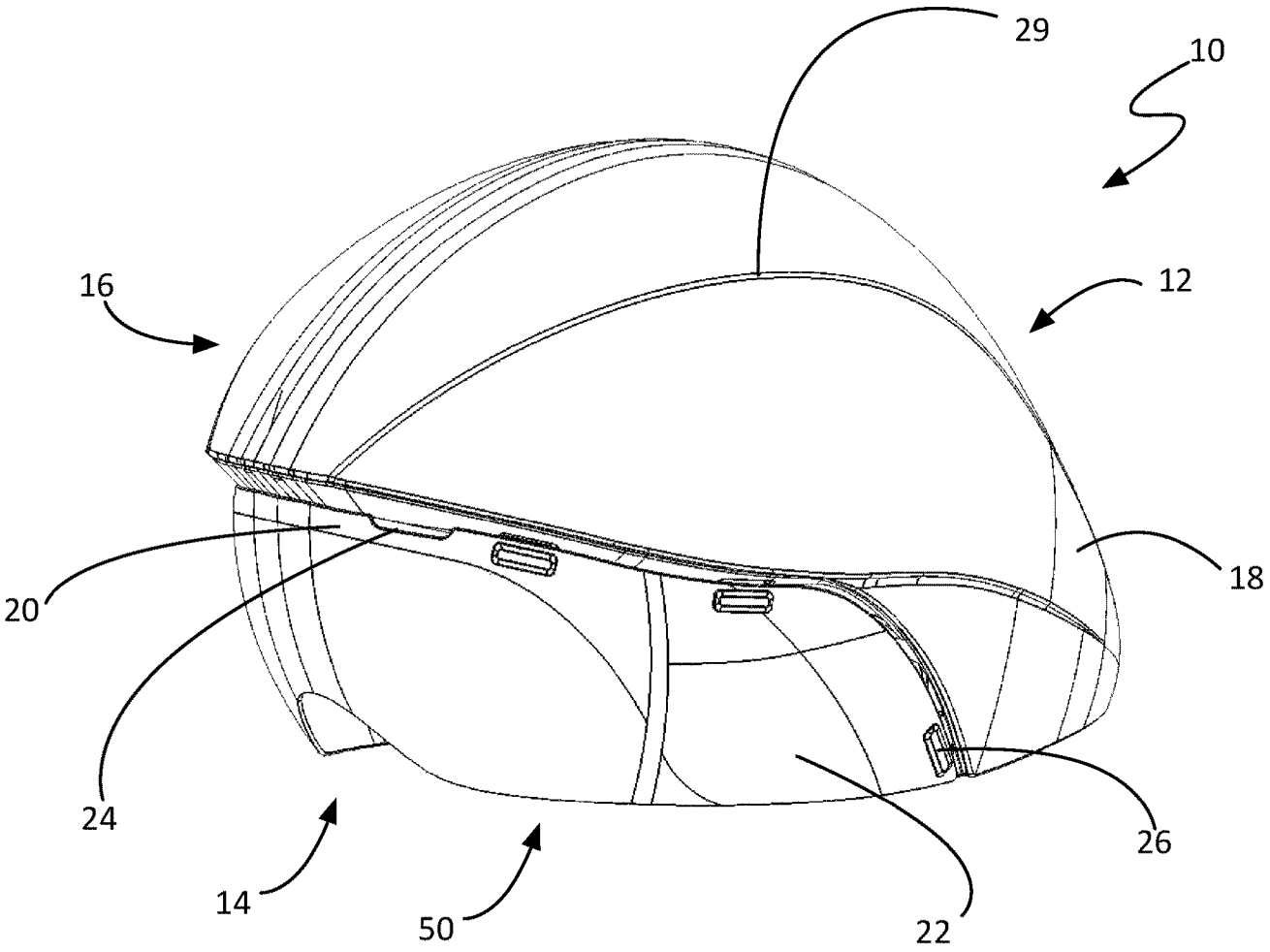
FIG. 1 is a perspective view of a helmet with a full shield.

This disclosure, its aspects and implementations, are not limited to the specific helmet or material types, or other system component examples, or methods disclosed herein. Many additional components, manufacturing and assembly procedures known in the art consistent with helmet manufacture are contemplated for use with particular implementations from this disclosure. Accordingly, for example, although particular implementations are disclosed, such implementations and implementing components may comprise any components, models, types, materials, versions, quantities, and/or the like as is known in the art for such systems and implementing components, consistent with the intended operation.

The word "exemplary," "example," or various forms thereof are used herein to mean serving as an example, instance, or illustration. Any aspect or design described herein as "exemplary" or as an "example" is not necessarily to be construed as preferred or advantageous over other aspects or designs. Furthermore, examples are provided solely for purposes of clarity and understanding and are not meant to limit or restrict the disclosed subject matter or relevant portions of this disclosure in any manner. It is to be appreciated that a myriad of additional or alternate examples of varying scope could have been presented, but have been omitted for purposes of brevity.

While this disclosure includes a number of embodiments in many different forms, there is shown in the drawings and will herein be described in detail particular embodiments with the understanding that the present disclosure is to be considered as an exemplification of the principles of the disclosed methods and systems, and is not intended to limit the broad aspect of the disclosed concepts to the embodiments illustrated.

Figure 2:
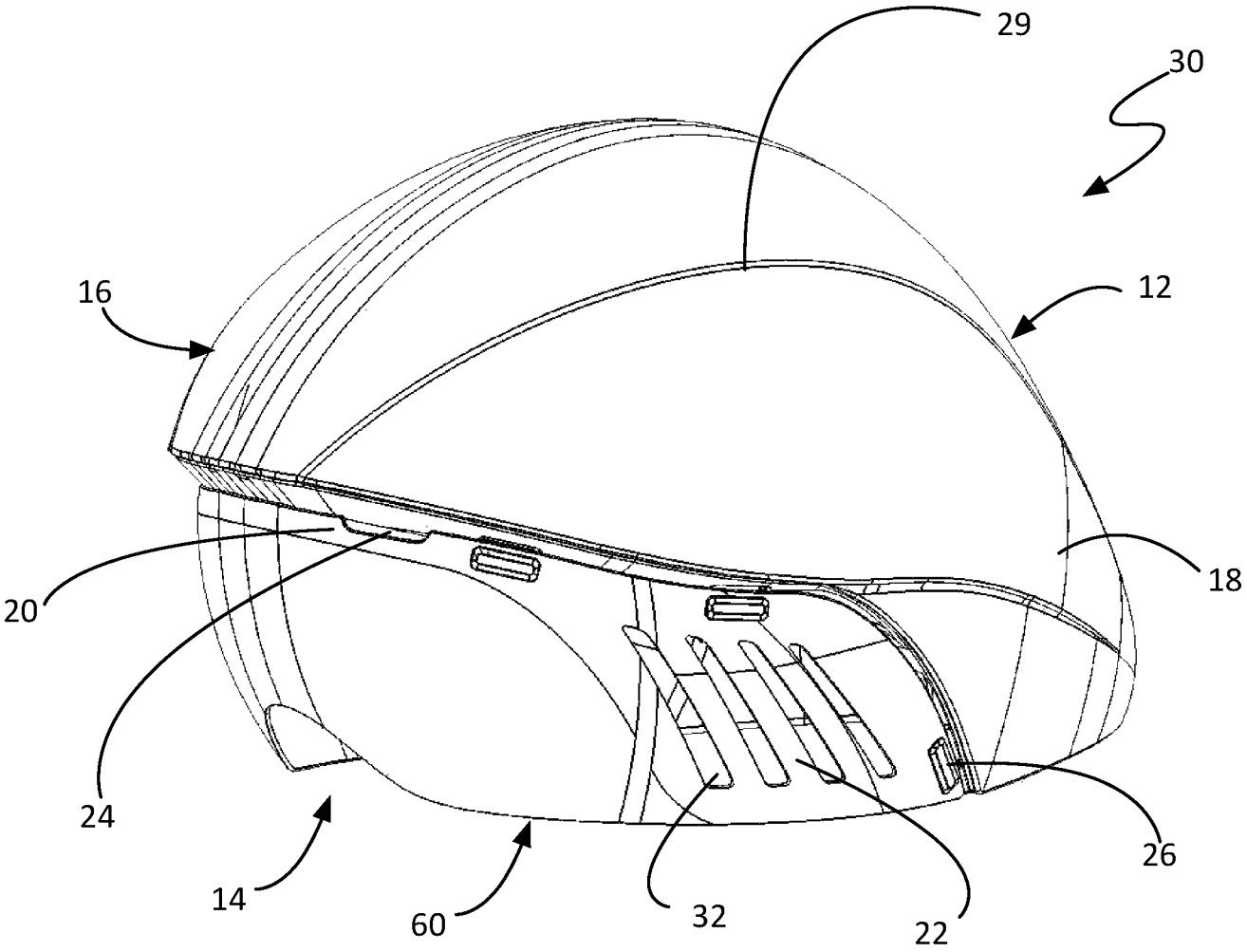
FIG. 2 is a perspective view of a helmet with a vented shield.
Figure 3:
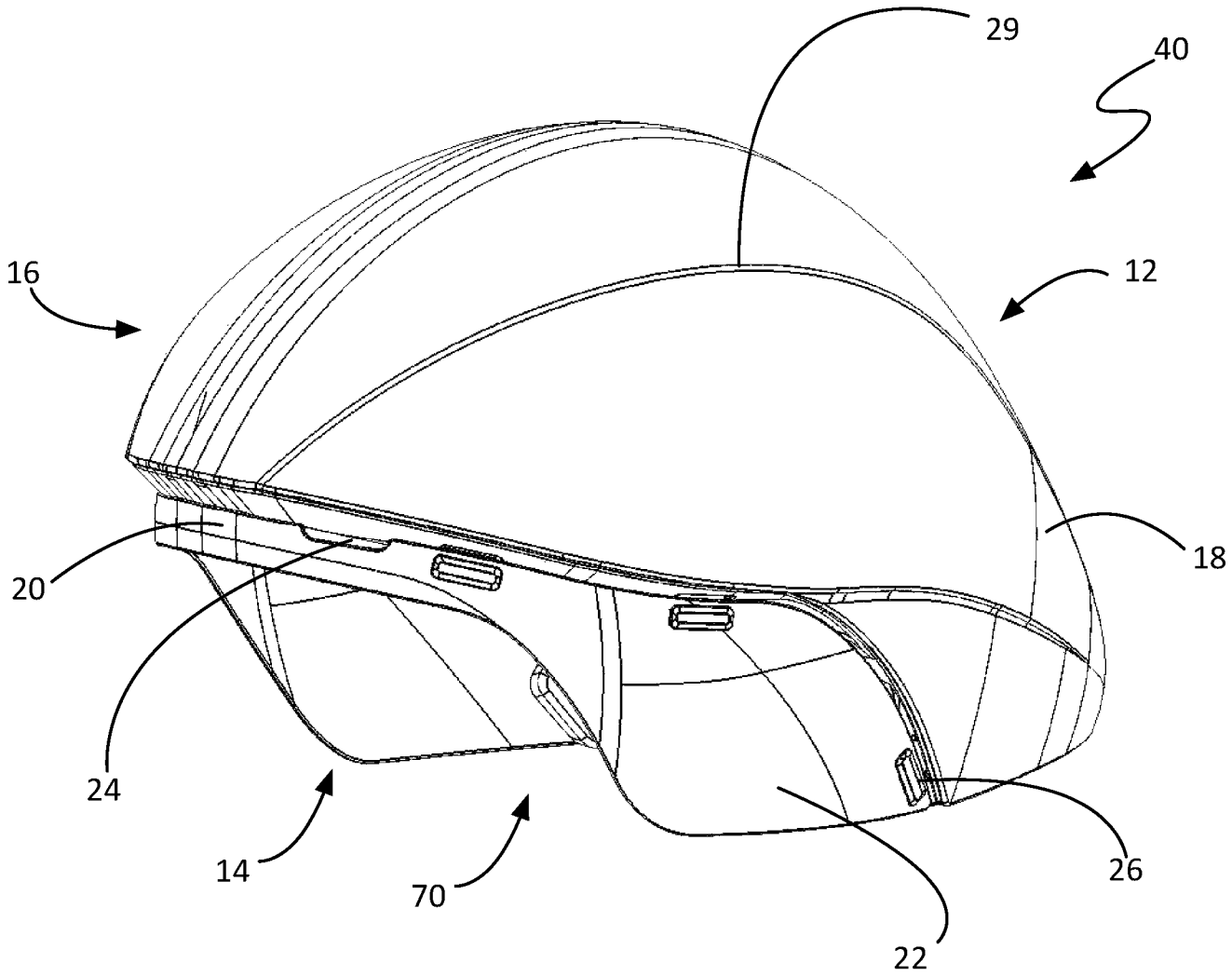
FIG. 3 is a perspective view of a helmet with a partial shield.

FIGS. 1-3 depict perspective views of non-limiting examples of helmets with shields 14, which can include shields 50, 60, and 70. Specifically, FIG. 1 shows a helmet 10, a helmet body 12, a shield 14, a front portion 16 of the helmet body 12, a tail portion 18 of the helmet body 12, a brow portion 20 of the shield 14, an ear portion 22 of the shield 14, a brow vent 24, a shield magnet 26, a bone line 29, and a full shield 50. Furthermore, FIG. 2 shows a helmet 30 having the elements of helmet 10, but with a vented shield 60 instead of the full, unvented shield 50. FIG. 2 includes at least one ear vent 32. Finally, FIG. 3 shows a helmet 40 having the elements of helmet 10 and 30, but with a shield 70 with the eye portion unshielded in the place of the full shield 50 of FIG. 1 or the vented shield 60 of FIG. 2.

A helmet (e.g. helmet 10 of FIG. 1, helmet 30 of FIG. 2, helmet 40 of FIG. 3 etc.) is a form of protective gear designed to protect the head from injury. Contemplated in this disclosure are helmets intended for use in bicycle time trials (TT), a use scenario where different needs are carefully balanced. The goal of a time trial is to traverse a course or track in the fastest time possible; an aerodynamic advantage may improve time trial results. A time trial helmet ideally will provide an aerodynamic advantage, or at least minimize drag caused by the helmet, without sacrificing the protection afforded the user. At the same time, the helmet needs to be comfortable enough to not interfere with race performance. Thus, ventilation and weight are concerns that need to be balanced against the protection and reduced drag. Various aspects of the helmets of FIGS. 1-3 address these needs.

In the context of the present description, helmet body 12 can refers to any part of the helmet that is not a shield 14, but would not necessarily include straps or other ancillary or attachment features for securing the helmet to a head of the wearer or user. Stated another way, the helmet body 12 can refer, collectively, to an outer shell 11, an impact liner or energy absorbing layer 13, and a comfort liner or fit liner 19, as described in greater detail below. Generally, the protective helmet body 12 for the TT helmet examples disclosed herein, can comprise one or more energy absorbing materials 13, such as an in inner energy absorbing material disposed within the outer shell 11, although a protective helmet 10, 30, 40 need not have both. The helmets 10, 30, 40 can be formed as an in-molded helmet that may comprise one or more than one layers, such as three layers, which can include: (i) a thin outer shell 11, (ii) an impact liner or energy absorbing layer 13, and (iii) a comfort liner or fit liner 19, each of which is addressed in greater detail below.

The outer shell 11 may be formed of a plastic, resin, fiberglass, or other suitable material such as a polycarbonate (PC) shell, or a polyethylene terephthalate (PET) shell, whether stamped, in-molded, injection molded, vacuum formed, or formed by another suitable process. The outer shell 11 may comprise an outer surface 11*a* and an inner surface 11*b* opposite the outer surface 11*a*, outer surface 11*a* being farther from a head of the user 80 and the inner surface 11*b* being nearer the head of the user 80. The outer shell 11 may provide a material in which the impact liner 13 can be in-molded, may provide a smooth aerodynamic finish, and may provide a decorative finish for improved aesthetics. Polycarbonate shells are usually either in-molded in the form of a vacuum formed sheet, or alternatively, can be attached to the foam liner with an adhesive. In an embodiment, the polycarbonate shell is taped onto the foam liner after the polycarbonate shell is molded. The in-molded polycarbonate shell method may be employed as bike helmets used for road cycling. A thickness of the outer shell 11 can comprise a thickness or average thickness, measured between the outer surface 11*a* and the inner surface 11*b*, in a range of 0-5 mm or about 1, 2, or 3 mm.

The impact liner or energy absorbing layer 13 may be disposed inside and adjacent the outer shell. The impact liner 13 may comprise an outer surface 13*a* and an inner surface 13*b* opposite the outer surface 13*a*, the outer surface 13*a* being farther from a head of the user 80 and the inner surface 13*b* being nearer the head of the user 80. The outer surface 13*a* can be adjacent or in direct contact with the inner surface 11*b* of the shell 11. The energy absorbing layer 13 may be made of plastic, polymer, foam, or other suitable energy absorbing material to absorb energy and to contribute to energy management for protecting a wearer during impact. The energy absorbing layer 13 may include, without limitation, expanded polypropylene (EPP), expanded polystyrene (EPS), expanded polyurethane (EPTU or EPU), or expanded polyolefin (EPO). In-molded helmets are often formed such that the outer shell 11 of the helmet 10, 30, 40 is bonded directly to an energy absorbing expanding foam 13 as it is expanding and being molded into the shell. As such, the energy absorbing layer 13 may be in-molded as a single or monolithic body of energy absorbing material and an outer shell 11. Alternatively, in other embodiments the energy absorbing layer 13 may be formed of multiple portions or a plurality of portions. In any event, the energy absorbing material 13 can be configured to absorb energy from an impact by being crushed or cracking. The impact liner 13 may be permanently coupled to the outer shell 11 with an adhesive, glue, or other suitable chemical or mechanical attachment.

As a non-limiting example, the outer shell 11 may be made from a combination of carbon and fiberglass, in which the carbon shell may be permanently coupled to the energy absorbing layer 13, such as an EPS liner, using chemical or mechanical fastening, such as with a glue or adhesive. As another non-limiting example, the outer shell 11 may be made from a standard PC shell in which the energy absorbing layer is in-molded into the outer shell using a standard in-molding process.

The comfort liner or fit liner 19 may be optional, and may be disposed inside the outer shell 11 and the impact liner 13, such as with an outer surface 19*a* of the comfort liner 19 being disposed adjacent or indirect contact with an inner surface 13*b* of the impact liner 13. An inner surface 19*b* of the inner surface 19 can be in direct contact, co-planar, or co-terminus with a head of the user or wearer 80. In some instances the comfort liner may omitted entirely so that the inner surface 13*a* of the impact liner is in direct contact, co-planar, or co-terminus with a head of the user or wearer 80. The comfort liner 19 may be made of textiles, plastic, foam, or other suitable material, such as polyester or nylon. The comfort liner 19 may also include portions of a fit system, such as a fit system comprising a dial that can real in or pay out portions of the fit system to match a size, shape, or both a size and shape of the head of the user 80. In some instances, the comfort line 19 may comprise a low friction layer or slip plane for rotational energy management. The comfort liner 19 may be formed of one or more pads of material that can be joined together, or formed as discrete components, that are coupled to the in-molded helmet. The comfort liner 19 may be releasably or permanently attached to the impact liner 13 using snaps, hook and loop fasteners, adhesives, or other suitable materials. As such, the comfort liner 19 can provide a cushion and improved fit for the wearer of the in-molded helmet 10, 30, 40. A thickness of the comfort liner 19 can comprise a thickness or average thickness, measured between the outer surface 19 and the inner surface 19*b*, in a range of 0-10 mm, 3-7 mm, or about 5 mm.

The shields 14 releasably coupled to the helmets of FIGS. 1-3 may also be described as visors or lenses. The shield 14 may be made to be removable and be releasably coupled to the helmet body 12 to facilitate putting on and removing the helmet by the user. In the embodiments illustrated in FIGS. 1-3, the shield 14 is releasably coupled to the helmet body 12 with magnets (e.g. shield magnets 26, body magnets 86, etc.). In other embodiments any suitable attachment mechanism or combination of attachment mechanisms, including but not limited to, clips, latches, magnets, locks, slots, channels, hook and loop fasteners, friction (e.g. inserted into a tight slot in the helmet body 12, etc.) may be used. As seen in FIGS. 1 and 2, a notch or cutout can be formed in the lower edge of the shield 14 such that the shield 14 fits around a nose of the user 80 and the nose of the user 80 can extend beyond and forward of the shield when the helmet is being worn by the user 80.

Contours or a shape of the helmet may be made continuous across a transition between, or at an interface of, the helmet body 12 and the shield 14 to create a continuous, integral helmet with an improved aerodynamic look and performance. In the embodiments depicted in FIGS. 1-3, and elsewhere, the shield 14 operates as an integrated ear cover by extending from the front of the helmet to a side rear portion of the helmet. This can provide more aerodynamic performance and faster times for the cyclist, and allows a rider to cover and uncover both the rider's eyes and ears simultaneously. Accordingly, the helmet can be formed so that the shield 14 is part of a one-piece design that wraps around to side portions of the helmet to cover the ears 82 of the user 80, in addition to shielding the eyes 90 (e.g. the shield 14 of FIGS. 1 and 2, etc.). In contrast, conventional time trial helmets, as known in the art, have included ear covers integrated or formed as part of the helmet body 12. Conventional helmets have also included smaller removable shields that have just covered the eyes 90 of the user 80 without wrapping around to the sides and rear of the helmet to additionally cover the ears 82 of the user. As such, the improved design of the current time trial helmet disclosed herein and shown, e.g., in FIGS. 1-3 comprises a shield 14 that both functions as a cover for the eyes 90, face, both or neither, while also extending all the way back to cover the ears 82 of the user 80.

The shield 14 may be formed or molded as a single piece, or it may be assembled from two or more separate pieces. In some embodiments, the shield 14 may be covered with a coating having special optical properties (e.g. polarized, contrast enhancing, filtering a particular range of wavelengths, intensity reduction, etc.). In other embodiments, the shield 14 may incorporate some form of display technology (e.g. heads-up display, time/pace indicator, etc.).

A front portion 16 of the helmet body 12 refers to the leading part of the helmet body 12, particularly the portion of the helmet body 12 that is in front of or in alignment with a center of a helmet wearer's face. In contrast, a tail portion 18 of the helmet body 12 refers to the trailing part of the helmet body 12, particularly the portion of the helmet body 12 which is behind or in alignment with the back of the helmet users head. In various embodiments, the front portion 16 of the helmet may be rounded, while the tail portion 18 may be tapered, giving the helmet an overall tear-drop or seed-like shape. See, for example, FIG. 8. Such a shape offers aerodynamic advantages.

The brow portion 20 of the shield 14 refers to a connecting or bridge portion of the shield 14 that connects ear 82 (FIG. 5*a*) cover portions (e.g. ear portion 22, etc.) of the shield 14. In some embodiments, the shield 14 may not provide cover for the user's face or eyes 90. See, for example, the partial shield 70 of FIGS. 3 and 4C. The brow portion 20 allows the shield 14 to provide cover for the users ears 82, provide the aerodynamic advantages previously discussed, yet remain a single piece, as opposed to two separate ear covers. As seen in FIGS. 1-3, the brow portion 20 extends along the brow portion of the helmet at the lower front edge of the helmet body 12.

Figure 5A:
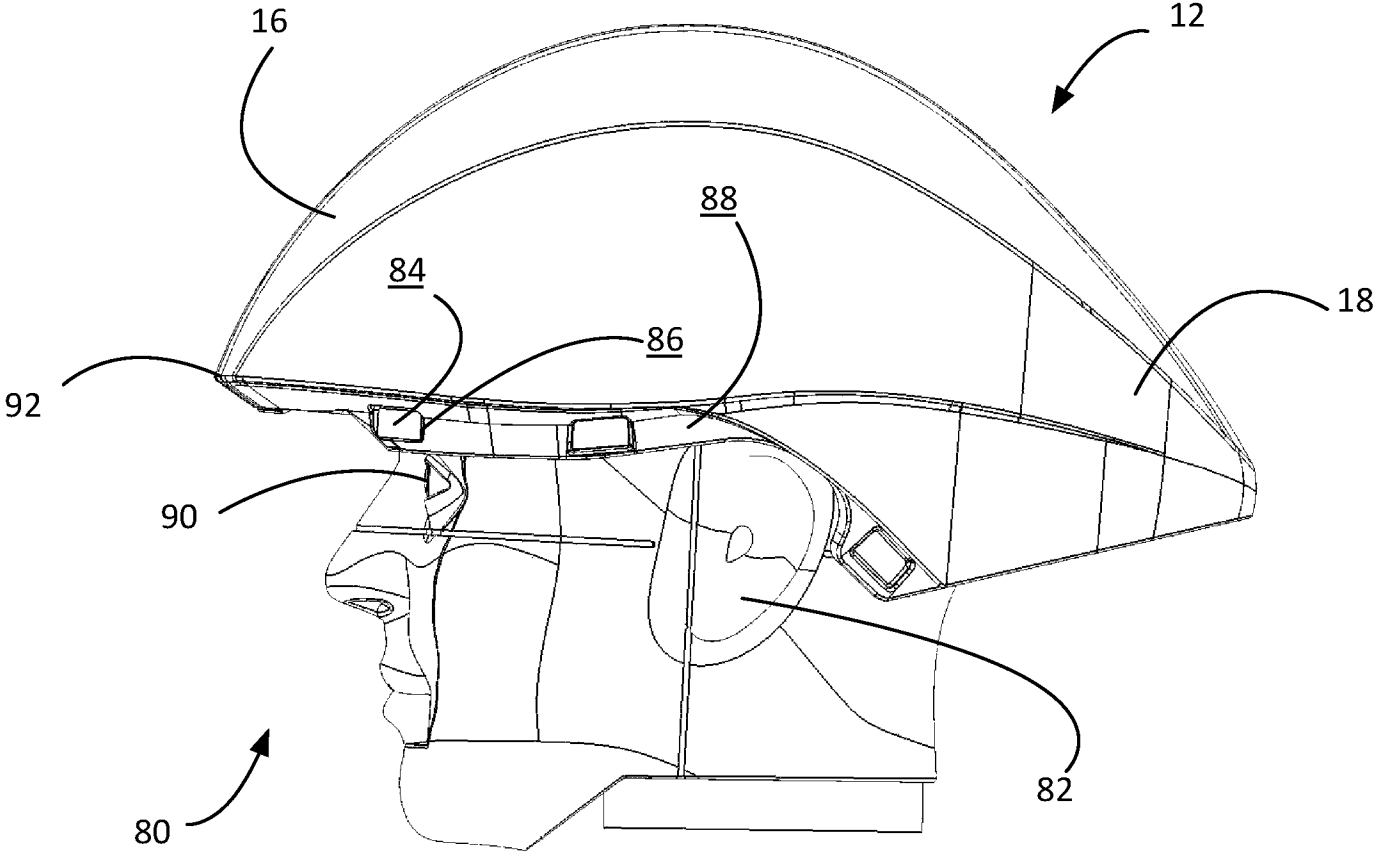
FIG. 5A is a side view of a helmet user wearing the helmet body of FIGS. 1-3.

The ear portion 22 of the shield 14 refers to the portion of the shield 14 that covers the helmet user's ears 82 (FIG. 5*a*). According to various embodiments, the ear portion 22 of the shield 14 is flush with the tail portion 18 of the helmet body 12, reducing drag. In some embodiments, such as that depicted in FIG. 1, the ear portion 22 of the shield 14 is a solid piece of material. In other embodiments, such as that depicted in FIG. 2, the ear portion 22 of the shield 14 includes one or more ear vents 32, to provide ventilation and aid the rider in hearing their environment. The size of the ear vent 32 should balance the desired ventilation versus a potential negative impact on aerodynamic advantage of the TT helmet.

The brow vent 24 in the shield 50, 60, 70 is an opening that allows a desired amount of air to pass into the helmet, such as for ventilation and cooling. While some airflow can be desirable, such as to reduce heat and improving cooing and comfort for a rider, excessive airflow can create unwanted drag, and decrease aerodynamic performance of the helmet. In the embodiments of the time trial helmet depicted in the Figures of this disclosure, the ventilation provided by the brow vents 24 passes between the top edge 52 of the shield 14 and the helmet body 12. As seen in FIGS. 1-3, the brow vents 24 are places where the top edge 52 of the shield 14 dips down, creating a gap when the shield 14 is seated with the helmet body 12. In other embodiments, the brow vent 24 may be shaped and located such that the ventilation provided passes entirely through the shield 14 or the helmet body 12.

A shield magnet 26 is a magnet attached to, or incorporated within, the shield 14, for the purpose of coupling with one or more body magnets 86 (e.g. magnets associated with the helmet body 12, etc.). A shield magnet 26 may be coupled to the shield 14 in a number of ways, including but not limited to one or more of, adhesive, clips, enclosures, in-molding, and any other suitable way of attachment. The shield magnets 26 of FIGS. 1-3 are coupled to the shield 14 using clips that are secured to the shield 14 through holes (e.g. shield magnet slot 54 of FIGS. 4A-C, etc.), according to one embodiment. As mentioned previously, other attachment mechanisms may be used in addition to or instead of magnets.

In some embodiments, the shield magnet 26 is a permanent magnet. In other embodiments, the shield magnet 26 may be replaced with a ferromagnetic material that can magnetically couple with the body magnets 86 of the helmet body 12.

A bone line 29 is a contour line along the exterior surface of the helmet, which contributes to the aerodynamic performance of the helmet. The bone lines 29 can begin at the front of the helmet and extend along the sides and top of the helmet to the rear of the helmet.

According to one embodiment, a helmet comprises a helmet body 12 and a shield 14. The helmet body 12 comprises a front portion 16 and a tail portion 18, and the shield 14 comprises two ear portions 22 connected by a brow portion 20. The shield 14 is releasably coupled to the helmet body 12. Furthermore, at least a portion of an ear 82 of a helmet user 80 is substantially exposed with respect to the helmet body 12 and covered with respect to the shield 14. Finally, the brow portion 20 of the shield 14 extends across the front portion 16 of the helmet.

The helmet may further comprise at least one body magnet 86 and at least one shield magnet 26 coupled to the shield 14. The at least one body magnet 86 and the at least one shield magnet 26 may be aligned with respect to each other such that the shield 14 can be magnetically coupled to the helmet body 12. The shield 14 may further comprise at least one brow vent 24 along a top edge 52 of the shield 14. Each ear portion 22 of the shield 14 may comprise at least one ear vent 32.

According to another embodiment, a helmet comprises a helmet body 12 and a shield 14. The helmet body 12 comprises a front portion 16 and a tail portion 18. The shield 14 comprises two ear portions 22 connected by a brow portion 20. The shield 14 is magnetically coupled to the helmet body 12. Furthermore, an ear 82 of a helmet user 80 is fully or nearly fully exposed with respect to the helmet body 12 and covered by or only by the shield 14. The brow portion 20 of the shield 14 extends across the front portion 16 of the helmet. Finally, the tail portion 18 is tapered and the front portion 16 has a rounded leading edge 92, such that the helmet body 12 has a tear drop 130 form.

According to yet another embodiment, a helmet comprises a helmet body 12 and a shield 14. The helmet body 12 comprises a front portion 16, a tail portion 18, and a plurality of body magnets 86. The shield 14 comprises a plurality of shield magnets 26, as well as two ear portions 22 connected by a brow portion 20. The shield 14 is releasably coupled to the helmet body 12 by the magnetic attraction between the plurality of body magnets 86 and the plurality of shield magnets 26. Also, an ear 82 of a helmet user 80 is substantially exposed with respect to the helmet body 12 and covered with respect to the shield 14. Finally, the brow portion 20 of the shield 14 extends across the front portion 16 of the helmet.

Figure 4A:
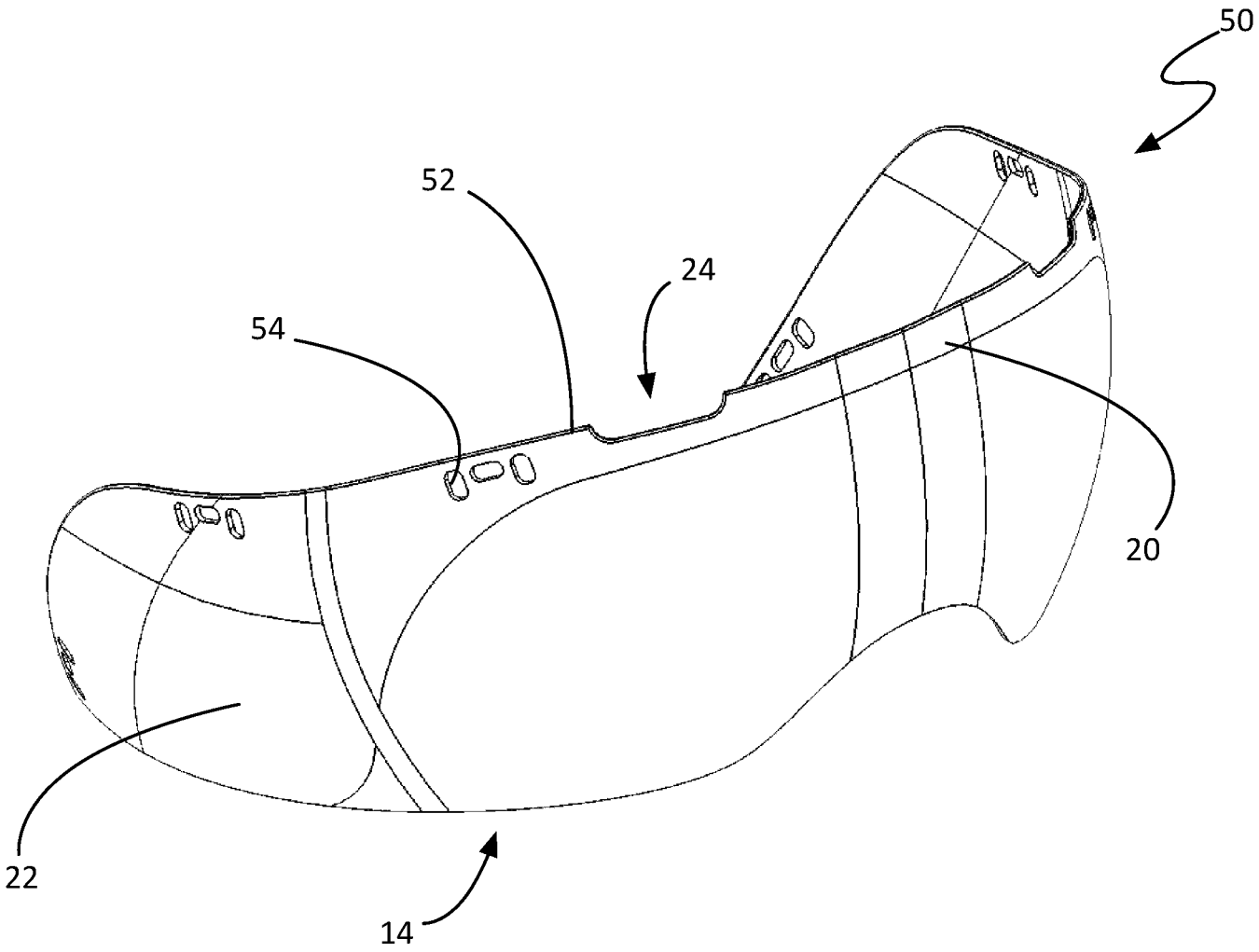
FIG. 4A is a perspective view of the full shield of FIG. 1.
Figure 4B:
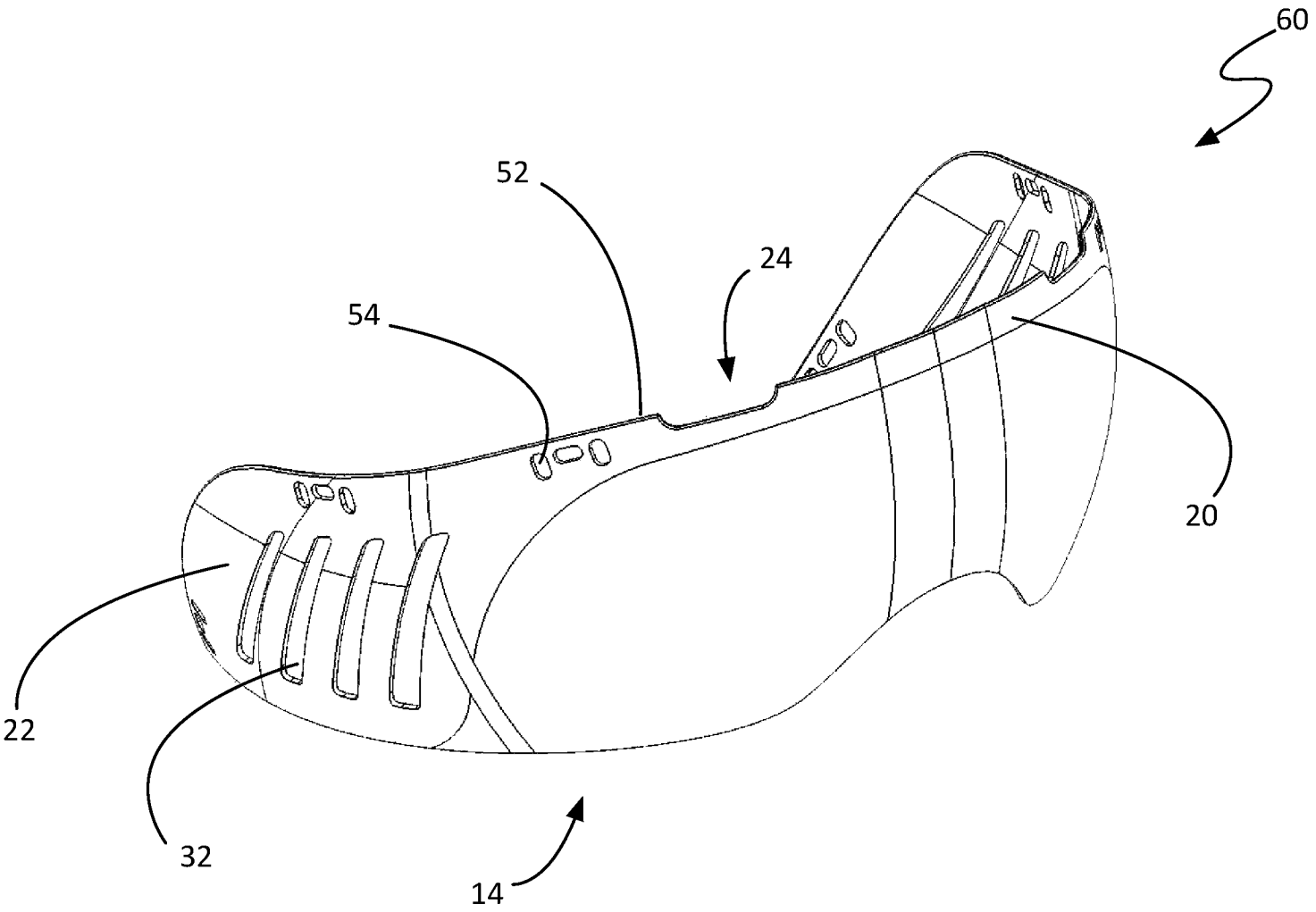
FIG. 4B is a perspective view of the vented shield of FIG. 2.
Figure 4C:
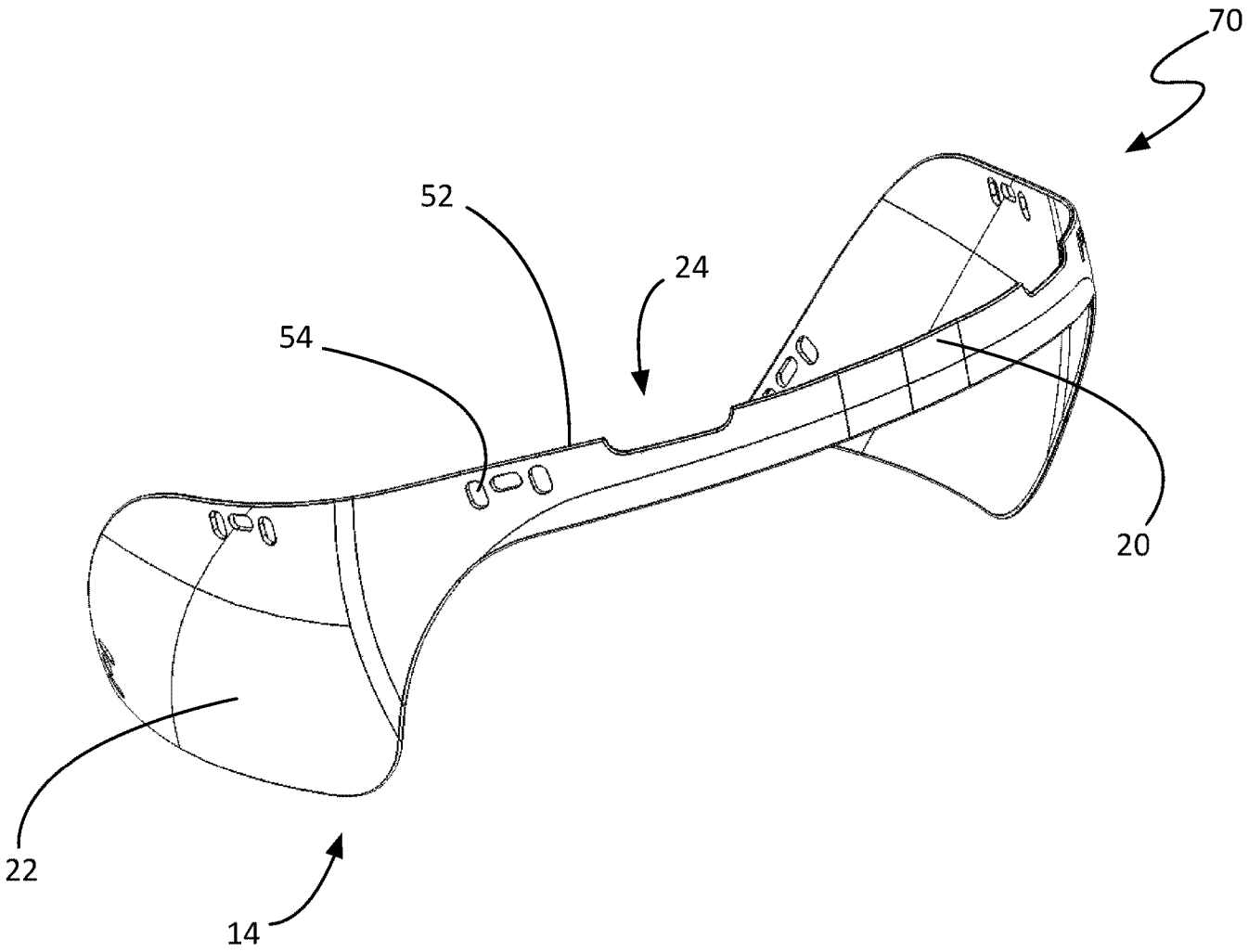
FIG. 4C is a perspective view of the partial shield of FIG. 3.

FIGS. 4A-C depict a perspective view of non-limiting examples of shields 14 for use with a time trial helmet. Specifically, FIG. 4A shows a full shield 50, as well as a shield magnetic slot 54. FIG. 4B shows a vented shield 60, and FIG. 4C shows a partial shield 70.

The full shield 50 of FIG. 4A (and FIG. 1) provides cover for both the ears 82 as well as the riders eyes 90. In some embodiments, the brow portion 20 of the full shield 50 may be extended downward to provide cover for just the rider's eyes 90, so their vision is not impaired as they race. In other embodiments, the brow portion 20 of the full shield 50 may be extended even further downward, covering more of the rider's face. This may provide aerodynamic benefits. The single-piece nature of the full shield 50 may make it more aerodynamic than other shields 14, such as the partial shield 70 and the vented shield 60, but at the cost of ventilation and comfort. The full shield 50 may be made of a single piece of material, or it may be assembled from multiple pieces.

The vented shield 60 of FIG. 4B (and FIG. 2), provides cover for both the ears 82 as well as the rider's eyes 90, similar to the full shield 50. Furthermore, the vented shield 60 may cover more of the rider's face than their eyes 90, as discussed with respect to the full, unvented shield 50 above.

However, the vented shield 60 has one or more ear vents 32 located on the ear portions 22 along the side of the shield 14. These vents may provide needed ventilation and cooling, and may also server to allow sound to enter the time trial helmet, which may help the rider have better situational awareness as they race. The vented shield 60 may be made of a single piece of material, or it may be assembled from multiple pieces.

The partial shield 70 of FIG. 4C (and FIG. 3) provides cover for the rider's ears 82, but does not cover the rider's eyes 90. The partial shield 70 can therefore accommodate a rider wearing sunglasses or other eyeglasses, instead of using the shield 14 to cover their eyes 90. The brow portion 20 of the partial shield 70 is reduced in comparison to the brow portion 20 of the full shield 50 and the vented shield 60; the size of the brow portion 20 is sufficient to connect the two ear portions 22 securely.

The shield magnetic slot 54 is a feature of a shield 14 with which a shield magnet 26 may be coupled to the shield 14. As depicted in FIGS. 4A-C, the shield magnetic slot 54 may be one or more holes or slots in the shield 14 which may be used to anchor a shield magnet 26 to the shield 14. For example, in the embodiments depicted in FIGS. 1-3, the shield magnetic slots 54 are attached to clips with which the shield magnets 26 are coupled.

FIG. 5A depicts a side view of a helmet user 80 wearing the helmet body 12 of FIGS. 1-3, according to various embodiments. Specifically, FIG. 5*a* shows a helmet user 80, an ear 82, an indentation 84, a body magnet 86, a lip 88 of the helmet body 12, an eye 90, and a rounded leading edge 92.

FIG. 5A illustrates the time trial helmet on a user head without a shield 14 to show the relative position of the user's head and ear 82 with respect to the helmet. User heads are not uniform, and positions of ears 82 on user heads can change with respect to other users and with respect to the helmet. Thus, the position of the helmet user 80 or rider's ear 82 shown in FIG. 5A is a relative position. However, the relative position shown in FIG. 5A illustrates a position that is about as far back as a helmet user's ear 82 will typically go. As such, most ears 82 (or a majority of ears 82) will be situated farther forward, or nearer the front of the opening and more fully situated behind the ear portion 22 of the shield 14. Thus, most ears 82 will be mostly or completely exposed with respect to the helmet body 12 and mostly or completely exposed when the shield 14 is releasably decoupled from the helmet body 12.

The indentations 84 shown in FIG. 5A are sized to hold a shield magnet 26 while it is coupled to the shield 14, thus allowing the shield 14 to sit flush with the helmet body 12. The indentations 84 also serve as a visual and tactile guide for the helmet user 80 to align the shield 14 correctly with the helmet body 12, according to various embodiments. The helmet bodies of FIGS. 1-3 all make use of indentations 84. In other embodiments, the helmet body 12 may not include indentations 84. For example, if the shield magnets 26 couple with the shield 14 such that the interior surface of the shield 14 is unobstructed, and may sit flush with the helmet body 12 without requiring indentations 84. As an option, such embodiments may employ a visual indication of the location of the one or more body magnets 86 embedded in the helmet body 12, to assist with initial shield 14 alignment.

The body magnet 86 may be a magnet (e.g. permanent magnet, etc.) which is incorporated in the helmet body 12 such that it may magnetically couple with the shield magnet (s) 26, holding the shield 14 in place while the time trial helmet is in use. In some embodiments, the body magnet 86 may be embedded in the material of the helmet body 12 (i.e. in-molded, mechanically inserted post molding, etc.). In other embodiments, the body magnet 86 may be affixed to the surface, or affixed such that it is exposed. In embodiments such as the one depicted in FIG. 5A, which includes indentations 84 to receive the shield magnets 26, one or more body magnets 86 may be embedded in, or affixed to, the helmet body 12 in proximity to each indentation 84. In some embodiments, a reduced magnet (i.e. smaller, weaker, lighter, etc.) may be used for the shield magnets 26, and compensated for with amplified presence of body magnets 86 (e.g. using multiple body magnets 86 for each shield magnet 26, using stronger body magnets 86, etc.).

The indentations 84, the body magnets 86, or both, may be located in a lip 88 of the helmet body 12, as shown in FIG. 5*a*. The helmet body 12 may have one or more "lips" which provide an idealized surface where the shield 14 may be seated while being releasably coupled to the helmet body 12. As depicted in FIG. 5A, the lips 88 of the helmet body 12 are where indentations 84, the body magnets 86, or both, may be located.

The helmet body 12 of the helmets of FIGS. 1-3 illustrate a rounded leading edge 92, for aerodynamic purposes. The rounded leading edge 92 is located on the front portion 16 of the helmet body 12, according to various embodiments.

According to various embodiments, at least one body magnet 86 may be encased within the helmet body 12. The helmet may further comprise at least one indentation 84 set in a lip 88 of the helmet body 12, at least one body magnet 86, and at least one shield magnet 26 coupled to the shield 14. At least one body magnet 86 may be encased within the helmet body 12 near the location of each indentation 84. Lastly, the shield magnets 26 may fit within the indentations 84.

Figure 5B:
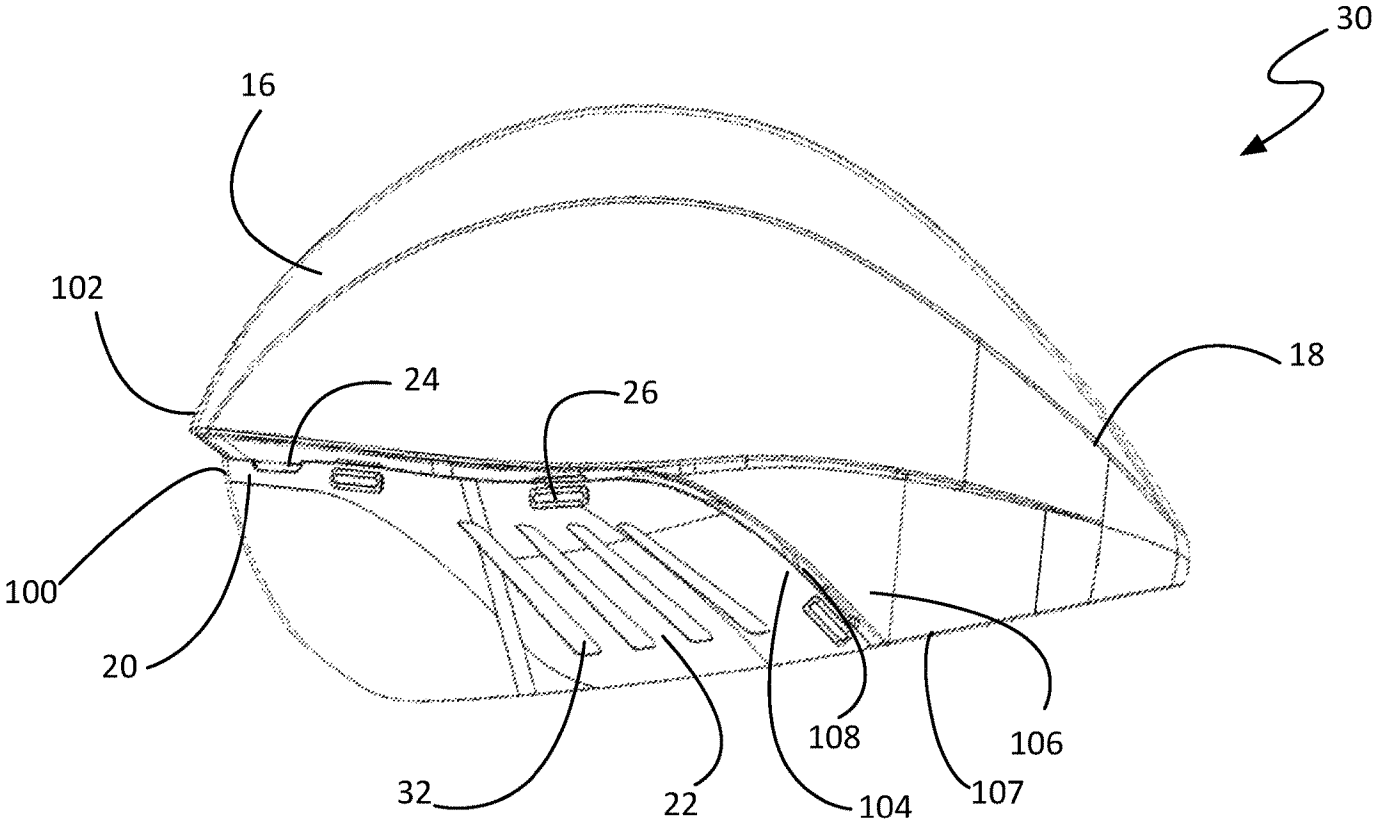
FIG. 5B is a side view of the helmet of FIG. 2.

FIG. 5B depicts a side view of the helmet of FIG. 2, according to various embodiments. As shown, a height of the helmet can taper to a minimum as the helmet tapers to a smaller size or lesser height at the rear tail or beak of the helmet. Additionally, FIG. 5B shows helmet 30 comprising an outer surface 100 of the brow portion 20, an outer surface 102 of the front portion 16, an outer surface 104 of the ear portions 22, and an outer surface 106 of a side of the tail portion 18. The tail portion also includes a lower edge 107, and a front edge 108 facing generally toward the direction of the front portion 16 opposite the tail portion 18. Contours or a shape of the helmet can be continuous across a transition between, or at an interface of, the helmet body 12 and the shield 14 to create a continuous, integral helmet with an improved aerodynamic look and performance.

According to various embodiments, an outer surface 100 of the brow portion 20 of the shield 14 may be recessed with respect to an outer surface 102 of the front portion 16 of the helmet body 12. An outer surface 104 of the two ear portions 22 of the shield 14 may be substantially flush with an outer surface 106 of the tail portion 18 of the helmet body 12. Alternatively, an outer surface of the shield 14 may be recessed with respect to an outer surface 102 of the front portion 16 of the helmet body 12. Also, the outer surface of the shield 14 may be substantially flush with an outer surface 106 of the tail portion 18 of the helmet body 12.

The outer surface 100 of the brow portion 20 refers to the exterior surface of the shield 14 localized around the brow portion 20. The outer surface 102 of the front portion 16 refers to the exterior surface of the helmet body 12 (e.g. the outer shell, etc.) localized around the region where the brow portion 20 of the shield 14 comes into contact with the helmet body 12.

The outer surface 104 of the ear portions 22 refers to the exterior surface of the shield 14 localized around the ear portion 22 or, more specifically, the exterior surface of the shield 14 near the rear of the shield 14. The outer surface 106 of the tail portion 18 refers to the exterior surface of the helmet body 12 (e.g. the outer shell, etc.) localized around the region where the ear portion 22 of the shield 14 comes in contact with the helmet body 12.

The view of FIG. 5B shows that the front portion 16 of the helmet can be formed by the outer shell and a front portion 16 of the energy absorbing layer disposed farther forward than the shield 14. Stated another way, the shield 14 can be recessed with respect to the front-most part, or leading edge, of the helmet so that a portion of the outer shell and energy absorbing layer can overhang the shield 14.

Regarding aerodynamics, bumping out the entire front of the helmet body 12, or extending the front portion 16 of the helmet body 12 farther forward with respect to the shield 14, as shown FIG. 5B has resulted in improved performance through reduced drag, or lower drag rating numbers, for the helmet. The unexpected result of reduced drag and improved aerodynamic performance of the helmet due to the thickened or forwardly positioned brow portion is thought to potentially be a result of the helmet creating a larger fairing surface that does a better job at directing air over the riders body, rather than down to the face and chest of the rider.

Figure 6A:
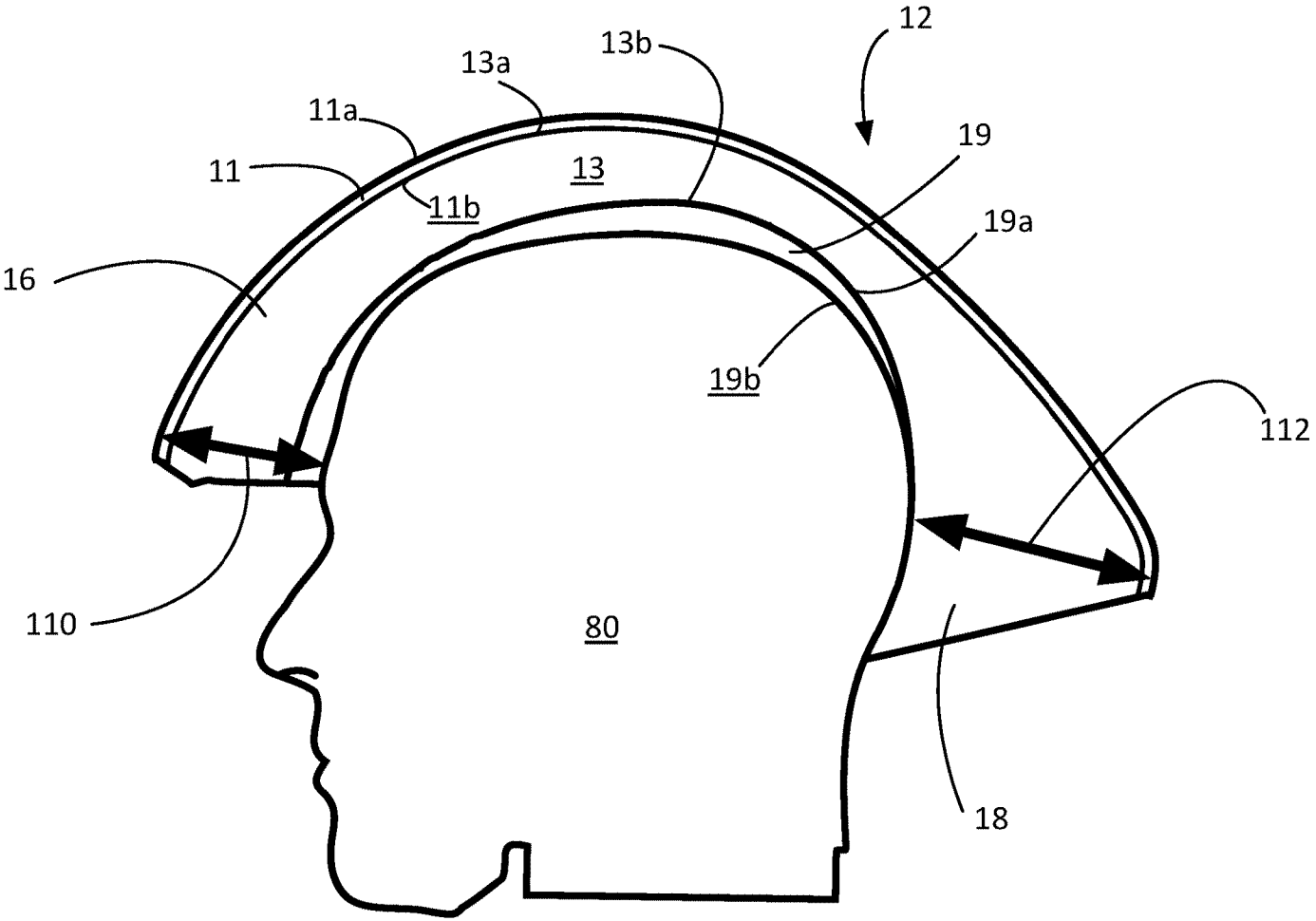
FIG. 6A is a cross-sectional side view of the helmet user wearing the helmet body of FIG. 5A.
Figure 6B:
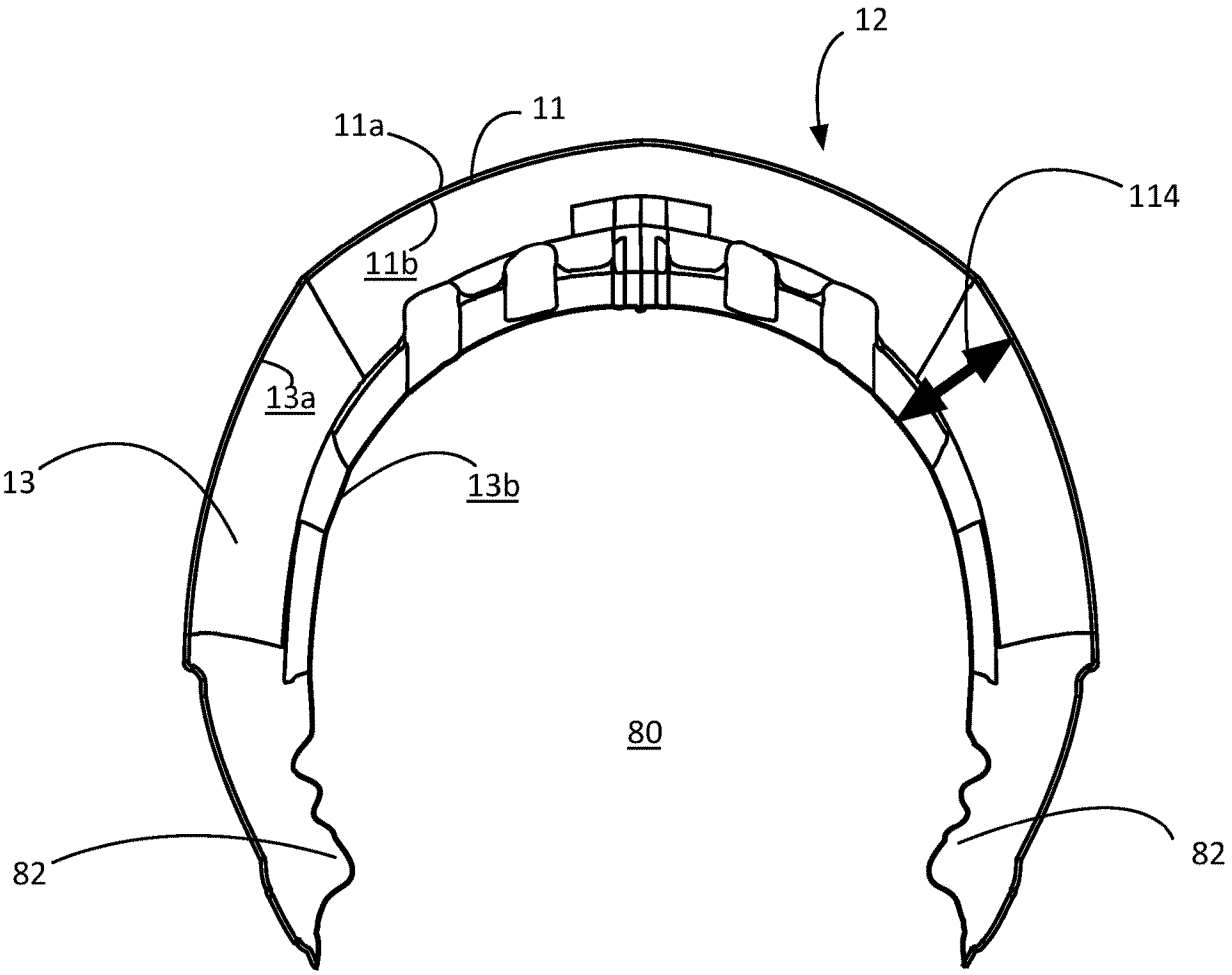
FIG. 6B is a cross-sectional front view of the helmet user wearing the helmet body of FIG. 5A.

FIGS. 6A and 6B illustrate cross-sectional views of the helmet user 80 wearing the helmet body 12 of FIG. 5A. Specifically, FIG. 6A shows a side view, which includes a maximum thickness 110 of the front portion 16, and a maximum thickness 112 of the tail portion 18. FIG. 6B shows a front view that includes a representation of the average thickness 114 of the helmet body 12, discounting the contributions of the front portion 16 and the tail portion 18.

Helmet thickness, as discussed herein, and in particular a thickness 110 of the front or brow portion 16 of the helmet body 12 and a thickness 112 of the tail portion 18, can be measured as the distance from the head of the helmet user 80 to the exterior of the helmet body 12. More specifically, the brow thickness 110 or the tail thickness 112 of the helmet 10, 30, 40, can be measured near the lowest part of the helmet as the distance that extends from the inner or interior surface of the helmet body 12, such as the inner surface 19*b* of the comfort liner 19 or the inner surface 13*b* of the impact liner 13, to the exterior or outer surface of the helmet body 12. Brow thickness 110 can be measured, for example, from the outer surface 13*a* of the impact liner 13 or the outer surface 11*a* of the outer shell 11 adjacent and above the wearer's eyes. The thickness 110 may be made thicker than the thicknesses of other helmets previously used for cycling. For example, typical brow thicknesses for the energy absorbing materials of conventional helmets have been less than about 33 millimeters (mm) or less than 30 mm, and have typically comprised thicknesses in ranges of about 20-30 mm, or about 25 mm, when not including a thickness or distance of a shield 14 as part of the brow thickness. To the contrary, the brow thickness 110 of the time trial helmets 10, 30, 40 shown in FIGS. 6A-B, is thicker than conventional helmets, and can include a thickness greater than 33 mm, greater than 35 mm, greater than 40 mm, and may comprise a thickness in a range substantially equal to, or about, 33-50 mm, or about 40-50 mm, or about 45 mm or 48 mm. As used herein with respect to the helmet brow thickness, the terms substantially equal to, or about, include variation in thicknesses in a range of 0-5 mm, 0-3 mm, and 0-1 mm, according to various embodiments. In order to pass impact testing in the brow portion 20, a helmet generally would need about 22 mm of energy absorbing material, like EPS foam, which is significantly less than the amount used in the helmets disclosed herein that can include about, or more than, twice the 22 mm of material.

With the exceptions of the tail portion 18 of the helmet body 12 that is thickened to form a teardrop shape for aerodynamic purposes, and the thickened front portion 16 of the helmet described above, the average thickness 114 of the helmet body 12 can be in a range of about 20-26 mm or about 22-24 mm. Thus, the thickness 110 of the front or brow portion of the helmet body 12 can be about twice the thickness of the rest of the helmet, with the exception of the rear tear-drop shape. As known in the art from conventional TT helmets, many helmets have a thickened rear section with a ratio of up to 4 times the thickness of the rest of the helmet.

By increasing a brow thickness 110 of the helmet, while maintaining more conventional helmet thicknesses for other parts of the helmet, additional protections and aerodynamic performance can be achieved by the disclosed helmet. For example, by moving the brow portion 20 forward, or extending the outer surface of the helmet 10, 30, 40 (such as the outer surface 11*a* or 13*a*) farther from the head of the user 80, a first interaction of the helmet 10, 30, 40 with the air or wind occurs earlier temporally, or at a greater distance spatially, from the user 80, which produces better aerodynamics for all head fore, aft, and yaw angles. Regarding protection, the energy absorbing layer 13, including foam as an energy absorbent material, can typically absorb more energy when more foam is present, but at some point the benefits from added foam do not outweigh the aerodynamic harm from too much bulk in front. Thus, the more foam or energy absorbing material 13 thickness that is present in the helmet, the better the helmet will perform in an impact test, but not necessarily better in an aerodynamic test. In the present case, the time trial helmet test results do indicate that impacts on the brow result in significantly lower accelerations than are present elsewhere on the helmet for improved helmet impact performance, while also providing improved aerodynamic performance.

According to various embodiments, the front portion 16 of the helmet body 12 may have a maximum thickness in a range of 40-50 mm. The tail portion 18 of the helmet body 12 may have a maximum thickness greater than the maximum thickness 110 of the front portion 16. The average thickness 114 of the portion of the helmet body 12 not included in either the front portion 16 or the tail portion 18 may be in a range of 20-26 mm.

Figure 7:
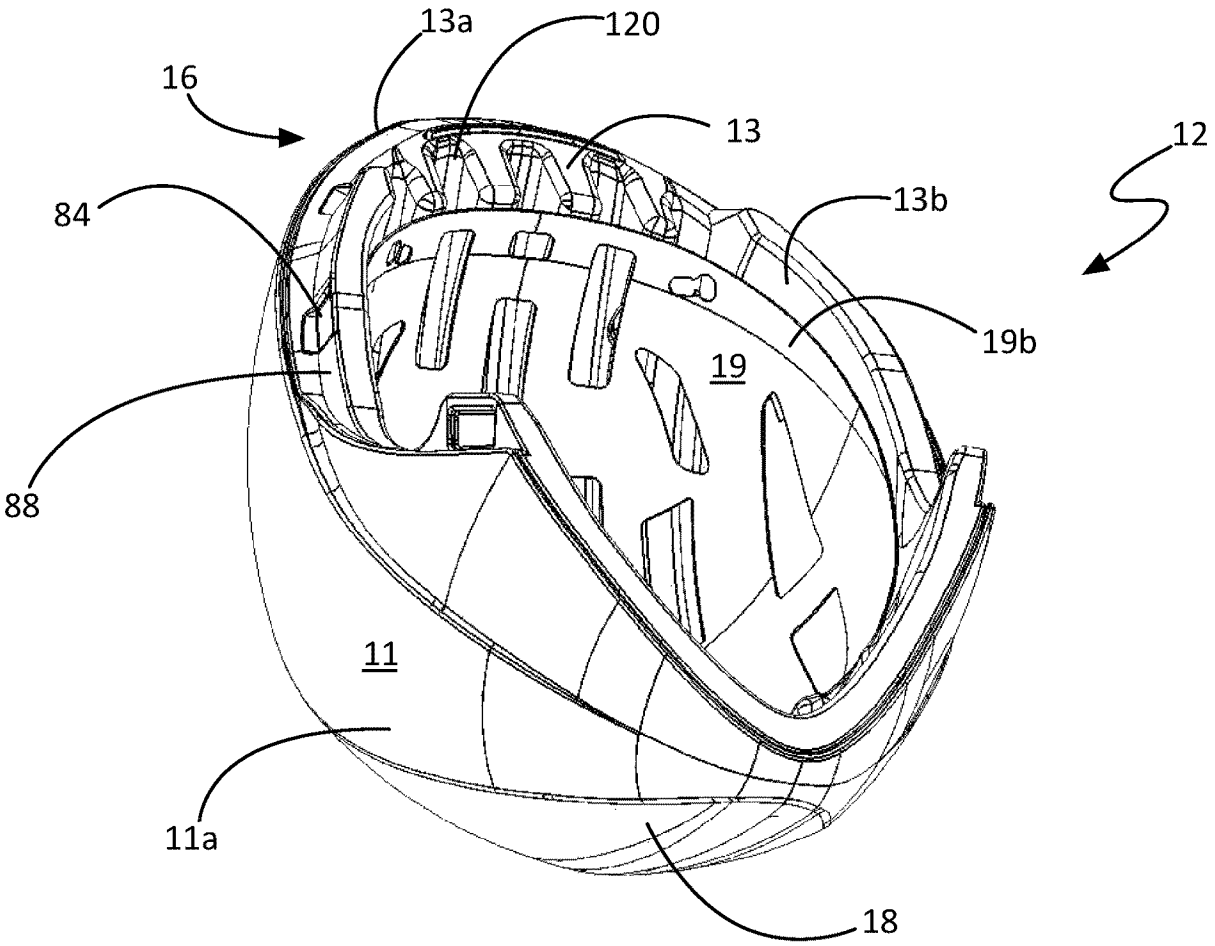
FIG. 7 is a perspective view of the bottom of the helmet body of FIGS. 1-3.

FIG. 7 depicts a perspective view of the bottom of the helmet body 12 of FIGS. 1-3. FIG. 7 shows a central and rear portion of an interior of the helmet that is configured to receive a head of the user. FIG. 7 also shows that the inner surface of the front portion 16 of the helmet body 12 can include one or more interior channels 120 that align with the brow vents 24 to control or direct airflow into the helmet and around the head of the user. An inner liner or comfort liner can be inserted into the interior of the helmet to improve helmet fit and to direct or channel airflow around a head of the user.

Figure 8:
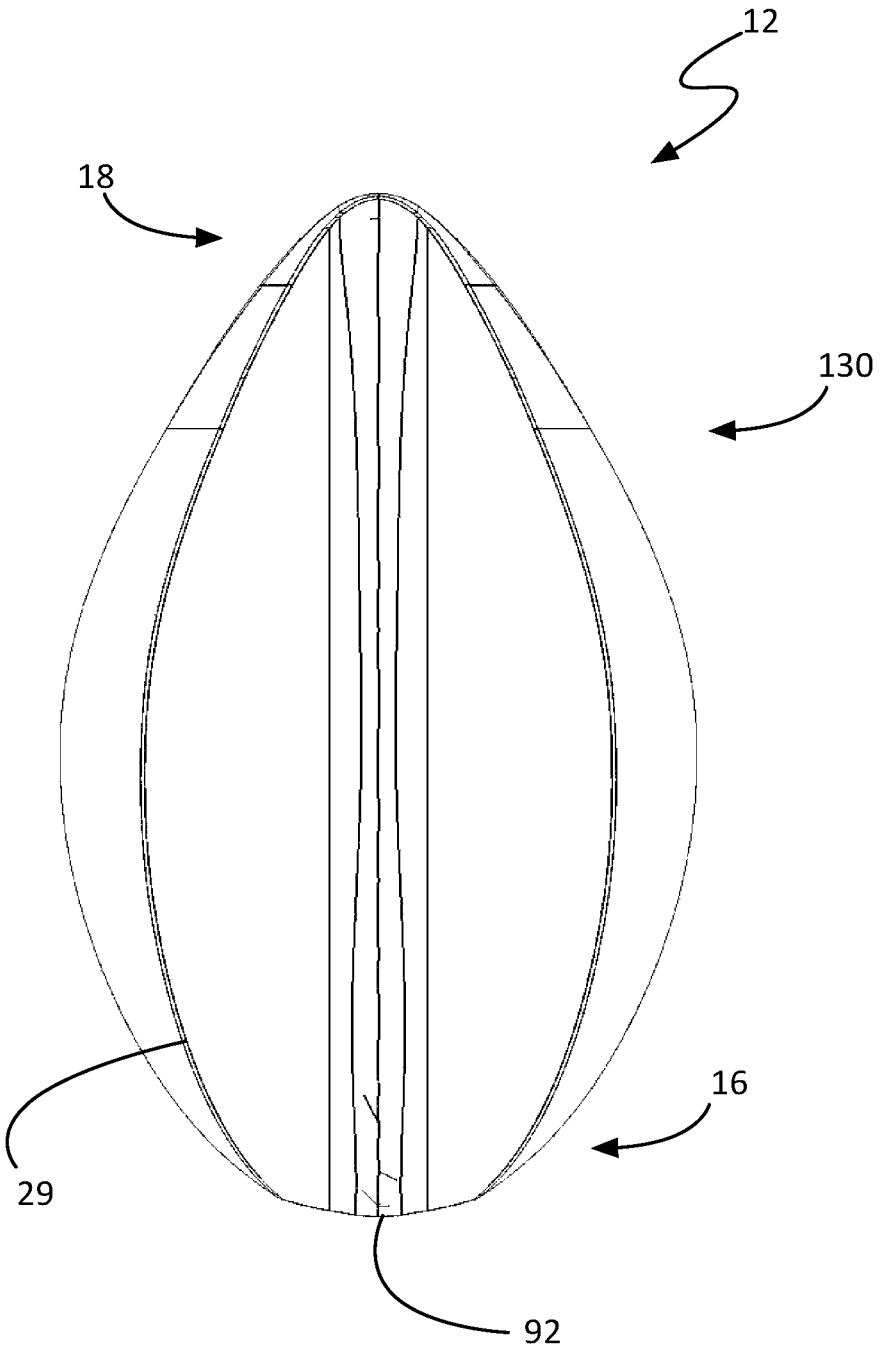
FIG. 8 is a top view of the helmet body of FIGS. 1-3.

FIG. 8 depicts a top view of the helmet body 12 of FIGS. 1-3. FIG. 8 shows that the time trial helmet can be formed comprising a footprint or shape that includes a rounded leading edge 92 and a tapered or pointed trailing or lagging edge such that an overall form factor of the helmet can resemble a tear drop 130 or a seed.

Figure 9:
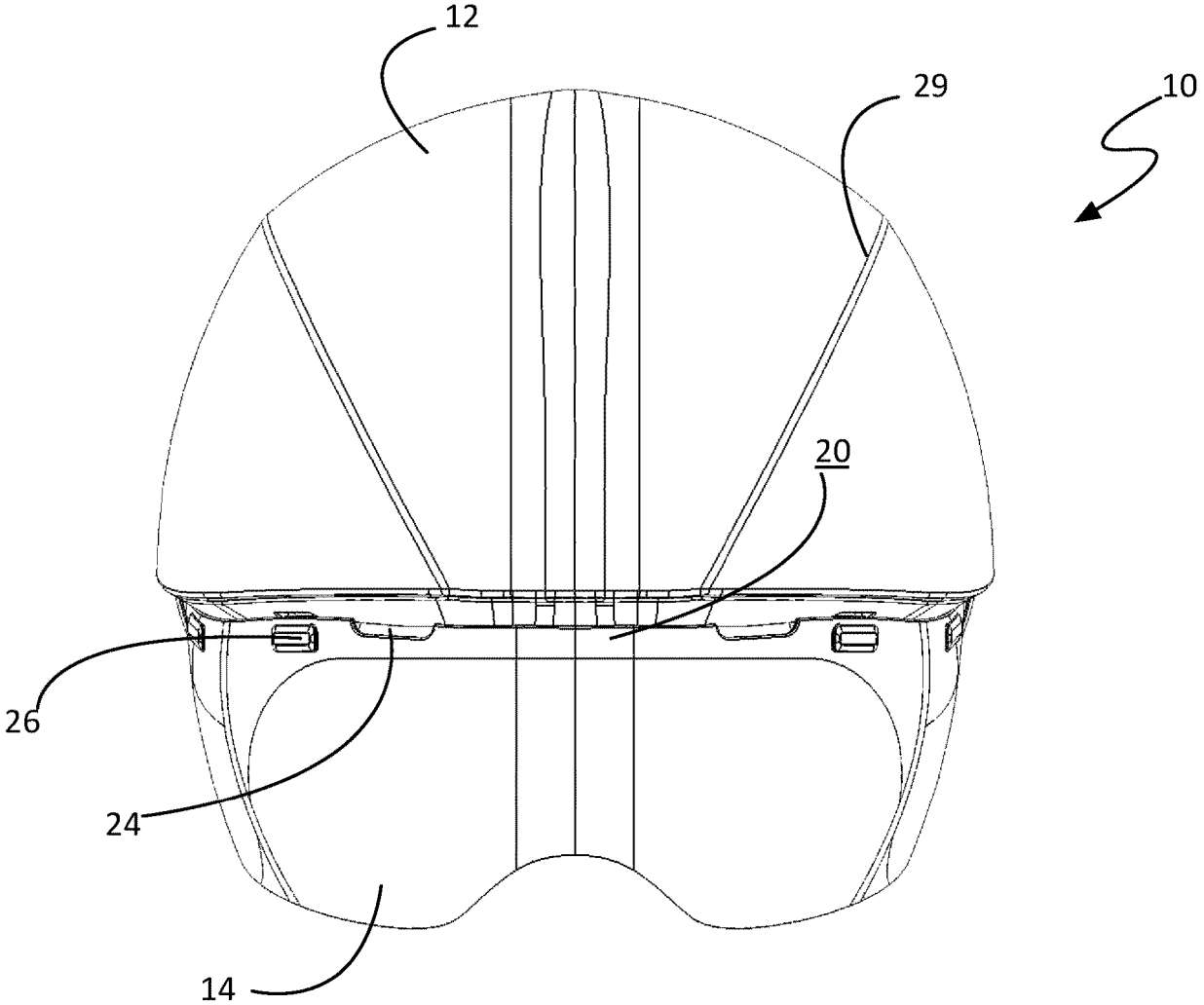
FIG. 9 is a front view of the helmet of FIG. 1.
Figure 10:
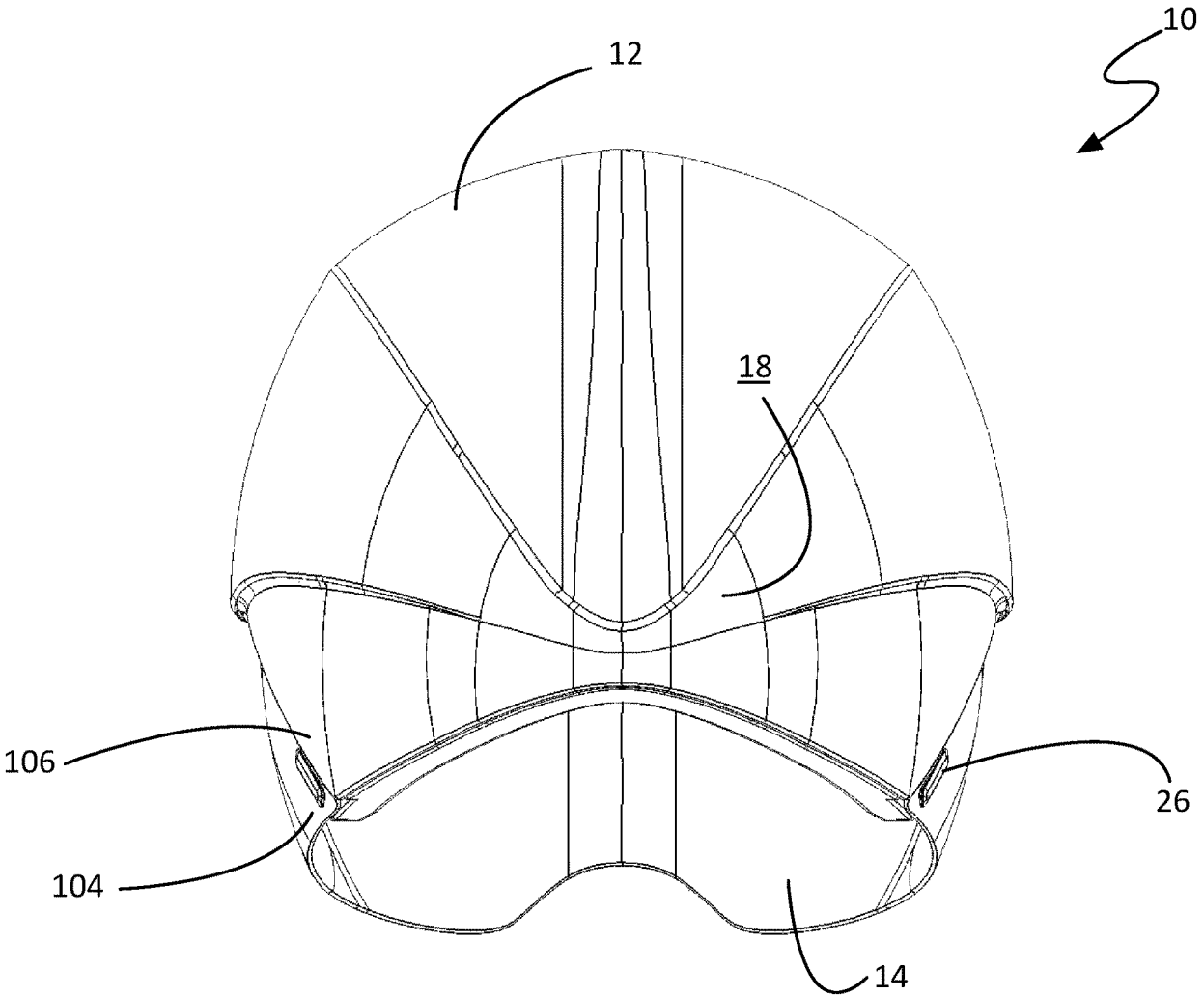
FIG. 10 is a rear view of the helmet of FIG. 1.

FIGS. 9-10 depict a front and rear view of helmet 10 of FIG. 1. The figures show a number of bone or contour lines 29 along the exterior surface of the helmet, which begin at the front of the helmet and extend along the sides and top of the helmet to the rear of the helmet. As shown in FIG. 10, the helmet may comprise an optimized anterior or trailing edge portion that comprises a beak shape and prominent "bone" lines that may be formed on both left and right sides of the helmet and extend from the front of the helmet to the back of the helmet to contribute to the aerodynamic performance of the helmet. In some embodiments, the anterior portion of the helmet may be hollow at an interior of the helmet, such as when a thickness of the helmet body 12 (or the outer shell and the energy absorbing layer) are of a substantially uniform thickness, or range in thicknesses from 10-50 millimeters.

Where the above examples, embodiments and implementations reference examples, it should be understood by those of ordinary skill in the art that other helmet and manufacturing devices and examples could be intermixed or substituted with those provided. In places where the description above refers to particular embodiments of helmets and customization methods, it should be readily apparent that a number of modifications may be made without departing from the spirit thereof and that these embodiments and implementations may be applied to other to helmet customization technologies as well. Accordingly, the disclosed subject matter is intended to embrace all such alterations, modifications and variations that fall within the spirit and scope of the disclosure and the knowledge of one of ordinary skill in the art.

What is claimed is:

1. A helmet, comprising:

an aerodynamic helmet body comprising a front portion, an opposite a tail portion, and an opening configured to receive a wearer's head, the tail portion comprising two side portions each having a lower edge curving downward behind an ear of a wearer when the helmet body is worn by the wearer; and a shield comprising two ear shield portions connected to each other adjacent the front portion of the helmet body by a brow portion;

wherein the shield is releasably coupled to the helmet body through magnetic coupling when the shield is connected to the helmet body, the magnetic coupling occurring between at least one shield magnet coupled to the shield and aligned with at least one body magnet in the helmet body; and wherein the helmet body is configured to leave a majority of the ear of the wearer exposed with respect to the helmet body, and the ear shield portions extend rearward from the brow portion of the shield aligned with the front portion of the helmet body to respective front edges of the two side portions of the tail portion and align aerodynamically with the two side portions of the tail portion and cover at least a portion of the ears of the wearer when connected to the helmet body adjacent to the front portion.

2. The helmet of claim 1, wherein an outer surface of the brow portion of the shield is recessed with respect to an outer surface of the front portion of the helmet body such that at least part of the helmet body overhangs the brow portion of the shield; and wherein the two ear portions of the shield are in direct contact with the two side portions of the tail portion of the helmet body.

3. The helmet of claim 1, wherein the at least one body magnet is encased within the helmet body.

4. The helmet of claim 1, further comprising a shield vent at a top edge of the brow portion of the shield that is separated from a corresponding portion of the front portion of the helmet body to leave an opening between the brow portion of the shield and the front portion of the helmet body when the shield is connected to the helmet body;

wherein the helmet body comprises at least one interior channel to direct air passing through the at least one brow vent into the helmet.

5. The helmet of claim 1, wherein the front portion of the helmet body comprising a maximum thickness in a range of 40-50 mm, the tail portion of the helmet body comprising a maximum thickness greater than the maximum thickness of the front portion.

6. The helmet of claim 1, wherein each ear portion of the shield comprises at least one ear vent extending through the ear portion of the shield.

7. The helmet of claim 1, wherein the brow portion of the shield comprises an eye shield that extends downward from the brow portion and is configured to cover at least the eyes of the helmet wearer.

8. A helmet, comprising:

an aerodynamic helmet body comprising a front portion, an opposite a tail portion, and an opening configured to receive a wearer's head, the tail portion having a lower edge curving downward and forming two side portions that leave a majority of ears of a wearer of the helmet body exposed with respect to the helmet body when the helmet body is worn by the wearer; and a shield comprising two ear portions connected by a brow portion adjacent the front portion of the helmet body;

wherein the shield is magnetically coupled to the helmet body through magnetic coupling when the shield is connected to the helmet body, the magnetic coupling occurring between at least one shield magnet coupled to the shield and aligned with at least one body magnet recessed into at least one of the two side portions of the helmet body;

wherein the helmet body is configured to avoid covering ears of a wearer of the helmet body when the helmet body is worn to leave a majority of the ear of the wearer exposed with respect to the helmet body, and the two ear portions of the shield are configured to extend rearward from the brow portion of the shield, aligned with the front portion of the helmet body, across and covering a majority of the ears of the wearer when the shield is worn, and to contact the two side portions of the tail portion to aerodynamically align with the two side portions of the tail portion when the shield is worn; and wherein the tail portion is tapered and the front portion has a rounded leading edge, such that the helmet body has a tear drop form factor.

9. The helmet of claim 8, wherein an outer surface of the brow portion of the shield is recessed with respect to an outer surface of the front portion of the helmet body such that at least part of the helmet body overhangs the brow portion of the shield, and wherein both outer surfaces of the two ear portions of the shield are substantially flush with an outer surface of the two side portions of the tail portion of the helmet body.

10. The helmet of claim 8, further comprising at least one indentation set in a lip of the helmet body, the at least one body magnet encased within the helmet body near the at least one indentation, and the at least one shield magnet coupled to the shield and sized to fit within the at least one indentation.

11. The helmet of claim 8, further comprising a shield vent at a top edge of the brow portion of the shield that is separated from a corresponding portion of the front portion of the helmet body to leave an opening between the brow portion of the shield and the front portion of the helmet body when the shield is connected to the helmet body;

wherein the helmet body comprises at least one interior channel to direct air passing through the at least one brow vent into the helmet.

12. The helmet of claim 8, wherein the front portion of the helmet body comprising a maximum thickness in a range of 40-50 mm, the tail portion of the helmet body comprising a maximum thickness greater than the maximum thickness of the front portion.

13. The helmet of claim 8, wherein each ear portion of the shield comprises at least one ear vent extending through the ear portion of the shield.

14. The helmet of claim 8, wherein the brow portion of the shield comprises an eye shield that extends downward from the brow portion and is configured to cover at least the eyes of the helmet wearer.

15. A helmet, comprising: a helmet body comprising a front portion, an opposite tail portion, an opening configured to receive a wearer's head, and a plurality of body magnets, the tail portion having a lower edge curving downward behind ears of a wearer of the helmet when the helmet is worn and the tail portion comprising at least one of the plurality of magnets on the tail portion behind a majority of the ears of the wearer when the helmet is worn; and a shield comprising a plurality of shield magnets and two ear portions connected by a brow portion adjacent the front portion, each of the two ear portions comprising at least one of the plurality of magnets;

wherein the shield is releasably coupled to the helmet body by magnetic attraction between the plurality of body magnets and the plurality of shield magnets, the plurality of body magnets aligned with the plurality of shield magnets when the shield is coupled to the helmet body; and wherein the helmet body is configured to avoid covering ears of a wearer of the helmet body when the helmet body is worn to leave a majority of the ears exposed with respect to the helmet body, and the two ear portions of the shield are configured to extend rearward from the brow portion aligned with the front portion of the helmet body to the tail portion, covering a majority of the ears of the wearer, and align with the tail portion behind a portion of the ears of the wearer when the shield is worn.

16. The helmet of claim 15, wherein an outer surface of the shield is recessed with respect to an outer surface of the front portion of the helmet body, and wherein the outer surface of the shield is substantially flush with an outer surface of the tail portion of the helmet body.

17. The helmet of claim 15, further comprising a shield vent at a top edge of the brow portion of the shield that is separated from a corresponding portion of the front portion of the helmet body to leave an opening between the brow portion of the shield and the front portion of the helmet body when the shield is connected to the helmet body;

wherein the helmet body comprises at least one interior channel to direct air passing through the at least one brow vent into the helmet.

18. The helmet of claim 15 wherein the front portion of the helmet body comprising a maximum thickness in a range of 40-50 mm, the tail portion of the helmet body comprising a maximum thickness greater than the maximum thickness of the front portion.

19. The helmet of claim 15, wherein each ear portion of the shield comprises at least one ear vent extending through the ear portion of the shield.

20. The helmet of claim 15, wherein the brow portion of the shield comprises an eye shield that extends downward from the brow portion and is configured to cover at least the eyes of the helmet wearer.

* * * * *